United States Patent [19]

Noisier

[11] Patent Number: 5,063,891

[45] Date of Patent: Nov. 12, 1991

[54] FUEL SUPPLY DEVICE FOR AN INTERNAL COMBUSTION ENGINE

[75] Inventor: Guy Noisier, Brunoy, France

[73] Assignee: Solex, Nanterre Cedex, France

[21] Appl. No.: 425,336

[22] Filed: Oct. 23, 1989

[30] Foreign Application Priority Data

Nov. 7, 1988 [FR] France ..... 88 14496

[51] Int. Cl.[5] ..... F02M 1/16

[52] U.S. Cl. ..... 123/187.5 R; 123/516; 123/179 L; 261/DIG. 8

[58] Field of Search ..... 123/516, 179 G, 179 L, 123/187.5 R, 447, 512; 261/DIG. 8

[56] References Cited

U.S. PATENT DOCUMENTS 3,805,758 4/1924 May ..... 123/187.5 R
4,554,896 11/1985 Sougawa ..... 123/187.5 R
4,684,484 8/1987 Guntly ..... 261/DIG. 8
4,735,751 4/1988 Guntly ..... 261/DIG. 8
4,814,114 3/1989 Charmley ..... 261/DIG. 8

*Primary Examiner*—Carl Stuart Miller
*Attorney, Agent, or Firm*—Larson and Taylor

[57] ABSTRACT

A fuel supply device for internal combustion engines comprises a constant level chamber, an engine-driven fuel pump having an outlet connected to the constant level chamber and an inlet connected to a fuel reservoir through a pipe provided with a non-return valve. A capacity located on the pipe is defined by a wall movable between a first position where the capacity has a maximum volume and a second position where the capacity has a minimum volume. A spring continuously biases the movable wall towards the first position. The movable wall is drawn to the second position responsive to start up of the engine.

5 Claims, 1 Drawing Sheet

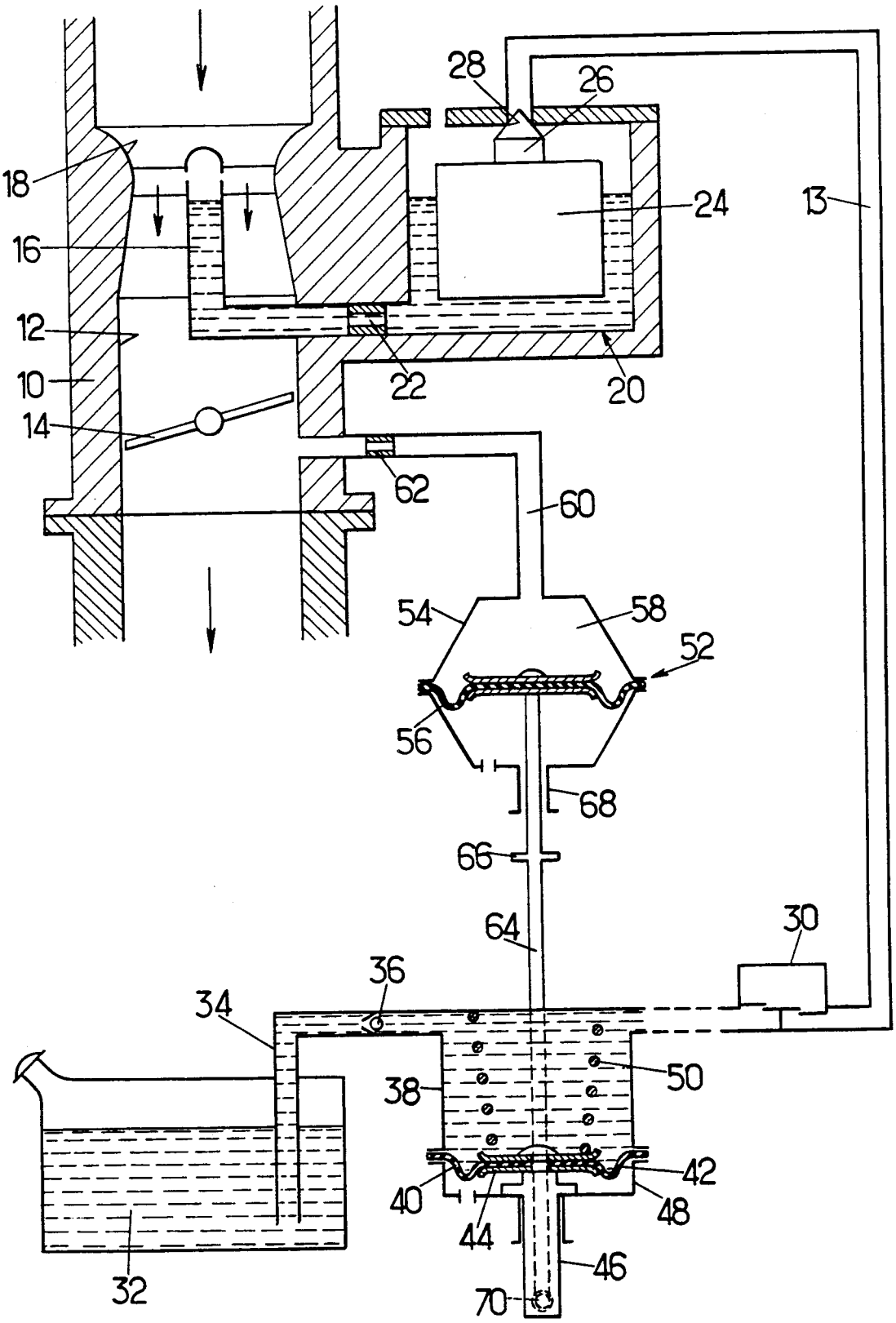
28
26
18
24
13
16
12
10
14
22
20
62
60
54
58
52
56
68
66
64
30
36
34
50
38
42
40
48
44
46
32
70

FUEL SUPPLY DEVICE FOR AN INTERNAL COMBUSTION ENGINE

BACKGROUND OF THE INVENTION

1. Field of the Invention

The present invention relates to fuel supply devices for internal combustion engines, having a constant level chamber fed from a reservoir by a pump driven mechanically by the engine.

2. Prior Art

Mechanically driven pumps are generally directly carried by the casing of the engine so as to facilitate transmission of movement. When the engine is stopped while hot, the pump, which is no longer cooled by the fuel which flows therethrough when it is operating, heats up. If the temperature under the bonnet is very high, the fuel contained in the pump vaporizes. If attempts are made to start up the engine again before cooling, the vapor or air which occupies the pump delays suction of fuel: that results particularly in an operating jerk of the engine as soon as the float chamber has become empty, since it is not yet supplied by the pump.

A supply device has already been proposed of the type in which a capacity or chamber is interposed between the reservoir and the pump and is separated from the reservoir by a non-return valve. The upper part of the capacity is connected to a pressurized air source during starting of the engine. Air drives the fuel contained in the capacity towards the pump.

This solution requires the introduction of air into the capacity, which is unfavorable; it requires a pressurized air source; it lacks progressivity.

SUMMARY OF THE INVENTION

An object of the present invention is to provide a supply device of the above-defined type assuring a fast repriming of the pump when it contains gas or vapor due to heating.

To this end, the capacity comprises a movable wall, return means which bias the movable wall toward a position in which the volume of the capacity is maximum and means for automatically moving the wall in the direction resulting in a reduction of volume in response to starting up of the engine.

The moving means are advantageously responsive to the depression which appears in the intake duct of the engine as soon as it runs, including under the action of the starter motor. The means may be formed by a pneumatic capsule driving the movable wall. The latter may be a deformable diaphragm, subjected to the action of return means which will typically consist of a spring.

The invention will be better understood from the following description of a particular embodiment, given by way of non-limitative example.

BRIEF DESCRIPTION OF THE DRAWINGS

The single FIGURE shows schematically, in section through a vertical plane, the components concerned by the invention of a fuel supply device.

DETAILED DESCRIPTION OF A PREFERRED EMBODIMENT

The device shown by way of example in the FIGURE uses moving means responsive to the depression generated in the intake duct during starting of the engine, which provides a simple, inexpensive construction not prone to failure.

The supply device comprises a carburetor whose body 10 is formed with an intake duct 12 which contains, disposed in this order from downstream to upstream, a throttle member 14 controlled by the driver, the outlet of a main fuel jet system 16 and a butterfly valve (not shown). The outlet of the main jet system is placed at the neck 18 of a venturi. Auxiliary circuits, not shown here because they are not concerned by the invention, also open into the intake duct.

The main jet system 16 is fed by a constant level chamber 20 through a main jet 22. The constant level chamber shown is of the type having a float 24 with a needle 26 which closes an intake orifice 28 as soon as the fuel in the tank reaches a predetermined level. The intake orifice 28 is fed by a mechanical pump 30 which draws fuel from a reservoir 32 through a pipe 34 in which is placed a non-return check valve 36.

Means for scavenging the pump when the engine is being started are interposed in pipe 34 between non-return valve 36 and pump 30. The scavenging means comprise a variable volume capacity 38. As shown in the FIGURE, the capacity comprises a bottom formed by a movable wall 40, consisting of a deformable diaphragm 42 and cups 44 provided with a push-rod 46. The periphery of the diaphragm 42 is clamped between a rigid wall of capacity 38 and a cover 48 which forms a stop member. Return means, formed by a helical spring 50 placed in the capacity, exert on the movable wall 40 a force which biases it in a direction increasing the volume of capacity 38. The movement of the movable wall is limited by abutment of a swelling of push-rod 46 against cover 48.

Capacity 38 is placed so as not to heat up as much as the pump, to avoid fuel vaporization of the capacity; it will be located remotely from the engine.

The drive means drivably connected to the movable wall 40 for moving it in a direction which reduces the volume of capacity 38 when the engine is started into operation comprise, in the case illustrated in the FIGURE, a pneumatic capsule 52 subjected to the depression which prevails in the intake duct, downstream of the throttle member 14. As shown, the capsule 52 comprises a case 54 clamping the periphery of a diaphragm 56 and defining therewith a work chamber 58. Chamber 58 is connected to a point of the intake duct situated downstream of the main throttle member 14 by a channel 60 having, in the embodiment shown, a calibrated restriction 62 whose function is to make the action of the capsule 52 more progressive. In some cases, this restriction is useless and may be omitted.

Diaphragm 56 is drivably connected to push-rod 46 of the variable volume capacity by a rod 64: the rod has an end bend engaged in a transverse hole 70 of the push-rod. Stop means are generally provided for limiting the movement of diaphragm 56 under the action of the depression: as illustrated in the FIGURE, they are formed by a bulge 66 of rod 64 and a flange 68 of the case.

The operation of the device is as follows:

When the engine is at rest, the elements are in the positions shown in the FIGURE. Chamber 58 of the pneumatic capsule 52 is at atmospheric pressure. Diaphragm 56 is balanced and rod 64 exerts no force on push-rod 46 which spring 50 maintains in abutment. The volume of chamber 38 is maximum. It is filled with fuel from the reservoir 32 due to drawn by pump 30, due to the last stroke of the movable wall when the engine is stopped.

When the engine is started again, the depression which appears in the intake duct 12 is transmitted to chamber 58. The pneumatic capsule 52 becomes operative and pulls rod 64, upwards in the FIGURE. Part of the fuel contained in the capacity is forced towards pump 30 (the non-return valve 36 being closed). If pump 30 has emptied itself of liquid fuel, because of its heating thereof, the vapors contained in pump 30 are forced in the carburetor, making repriming possible.

As long as the engine is operating, the movable wall of capacity 38 is held in a position in which it gives to the capacity the maximum volume defined by the stop means 66, 68.

As soon as the engine is stopped, spring 50 brings the movable wall back into the abutment position in which it is shown in the FIGURE and causes suction of fuel through the valve 36.

It can be seen that a reduction of volume of capacity 38 takes place whenever the engine is started, even if cold. Such operation is without drawback. However, means may be provided for returning to the reservoir fuel forced out by the capacity or preventing operation of the pneumatic capsule 52 in the case of cold starting of the engine.

What is claimed is:

1. A fuel supply device for an internal combustion engine, comprising:

a constant level chamber, an engine-driven fuel pump having an outlet connected to said constant level chamber and an inlet connected to a fuel reservoir through a pipe provided with non-return valve means, a chamber located on said pipe between said non-return valve means and pump, defined by movable wall means movable between a first position where said chamber has a maximum volume and a second position where said chamber has a minimum volume, return means continuously biasing said movable wall means toward said first position, and driving means responsive to the depression at a point of an intake duct of the engine located downstream of a driver-controlled throttle member to move said movable wall means toward said second position.

2. Device according to claim 1, wherein the driving means comprises a pneumatic capsule having movable means drivably connected to the movable wall means defining the chamber.

3. Device according to claim 2, wherein the movable wall means defining the chamber comprise a deformable diaphragm and a push-rod drivably connected to said movable means of the pneumatic capsule.

4. Device according to claim 3, wherein the return means comprise spring means located in said chamber.

5. Device according to claim 1, wherein said engine driven pump is directly carried on the casing of an engine and said chamber is at a location sufficiently remote from said pump and engine for avoiding fuel vaporization therein.

* * * * *